US008826778B1

(12) United States Patent
Minnick

(10) Patent No.: US 8,826,778 B1
(45) Date of Patent: Sep. 9, 2014

(54) APPARATUS AND METHOD FOR TIGHTENING OR LOOSENING TOILET SEAT

(76) Inventor: Randy Minnick, Springville, CA (US)

( * ) Notice: Subject to any disclaimer, the term of this patent is extended or adjusted under 35 U.S.C. 154(b) by 253 days.

(21) Appl. No.: 13/550,535

(22) Filed: Jul. 16, 2012

Related U.S. Application Data

(60) Provisional application No. 61/508,214, filed on Jul. 15, 2011.

(51) Int. Cl.
*B25B 13/48* (2006.01)
*B25B 13/06* (2006.01)
*B25B 13/50* (2006.01)

(52) U.S. Cl.
CPC ..... *B25B 13/50* (2013.01)
USPC ..... 81/124.2; 81/125.1; 81/176.15

(58) Field of Classification Search
USPC ..... 81/124.4, 125.1, 124.2, 176.15, 176.2
See application file for complete search history.

(56) References Cited

U.S. PATENT DOCUMENTS 4,562,758 A * 1/1986 Stirling ..... 81/124.4
5,542,321 A * 8/1996 Fuca ..... 81/125.1
6,314,841 B1 * 11/2001 Burk et al. ..... 81/125.1
7,069,820 B2 * 7/2006 Goacher, Sr. ..... 81/124.2
7,096,765 B1 * 8/2006 Diggle et al. ..... 81/124.4
7,413,693 B2 * 8/2008 Goacher, Sr. ..... 264/148
8,047,102 B2 * 11/2011 Gnatz ..... 81/124.2
2005/0150332 A1 * 7/2005 Russell ..... 81/125.1
2008/0066584 A1 * 3/2008 Vines ..... 81/124.2
2008/0098858 A1 * 5/2008 Thomas ..... 81/124.2
2009/0013832 A1 * 1/2009 Duffey et al. ..... 81/176.15

* cited by examiner

*Primary Examiner* — David B Thomas

(74) *Attorney, Agent, or Firm* — James M. Duncan, Esq.; Klein DeNatale Goldner

(57) ABSTRACT

A wrench is specifically configured for removing and installing toilet seats to toilet bowls, where a single wrench is adaptable to be used with a variety of different nuts commonly utilized to secure toilet seats to bowls. Each end of the wrench is configured to receive and engage a different variety of nut. Additional nut varieties may be received and engaged through the use of plug inserts which are received in each end of the wrench. The outer profiles of the plug inserts correspond to the internal profiles of each end of the wrench, while the internal profiles of the plug inserts are configured to receive and engage other sizes and forms of nuts. A method of use utilizes the wrench.

17 Claims, 4 Drawing Sheets

APPARATUS AND METHOD FOR TIGHTENING OR LOOSENING TOILET SEAT

CROSS-REFERENCE TO RELATED APPLICATIONS

U.S. Provisional Application No. 61/508,214 for this invention was filed on Jul. 15, 2011, for which application this inventor claims domestic priority.

BACKGROUND OF THE INVENTION

This invention relates to hand tools, such as open ended wrenches, sockets and screw drivers. More specifically, this invention relates to hand tools utilized to repair and adjust toilet components, specifically the attachment of toilet seats to the bowl, and removal of the seat from the bowl.

Anyone who has attempted to adjust a toilet seat by either tightening or loosening the fasteners which secure the seat to the bowl has no doubt experienced frustration. In the most common installation, the back of the toilet is adjacent to a wall. Thus, in order to manipulate the fasteners, one must often "hug" the bowl by reaching around it. The standard toilet seat mounting is relatively simple. A metal or plastic bolt goes through or integral to the hinge of the seat. The bolt may be concealed by a cover member. Once the cover over the bolt is opened, access is provided to a slotted bolt. Unfortunately, having access usually does not mean that the bolt is removed by simply unscrewing it, Under the currently known practice, the nut underneath the lip of the toilet bowl is normally retained by hand or with hand or pliers, and a screwdriver is utilized to try to unscrew the bolt.

With most seat fasteners, one portion of the fastener, usually the nut member, must be retained either by hand or with a tool while the other portion is rotated. This can be difficult and frustrating. The fasteners are often made of plastic materials and can be damaged from the prior use of tools which might break or distort the sides of the nut member. Such damage can make it difficult to obtain a secure attachment to the fastener. Likewise, given the damp environment, metallic hardware may rust and become very difficult to remove. To further complicate the process, several different types of nuts are utilized for securing the seat to the bowel. The present inventor is aware of five major different types of nuts which are utilized for this purpose, each one requiring a different type of tool, or size of tool, to fit. Failure to use the correct tool causes damage to the nut, resulting in the problem described above.

SUMMARY OF THE INVENTION

Embodiments of the apparatus disclosed herein provide a solution to the disadvantages described above for the known hand tool tools utilized for removing, attaching, or adjusting toilet seats. Embodiments of the presently disclosed device provide a unique wrench having sockets on opposing ends of the wrench, which sockets may capture the nuts generally utilized for mounting toilet seats. An embodiment of the wrench comprises a generally cylindrical body which provides a hand grip handle for rotating the sockets at either end of the extended body. The hand grip member has an outer wall, an inner wall, a first end and a second end, an intermediate section between the first end and the second end. The first end has a first central aperture which may extend into the intermediate section. The first central aperture may have a first internal profile which has two or more radially-extending lobes. Alternatively, the first internal profile may be a hexagonal or square profile. The first internal profile is adapted to receive and engage a nut which has an exterior profile which conforms to the first internal profile. The second end has a second central aperture which may also extend into the intermediate section. Among other possible internal profiles, the second central aperture may have a second internal profile which has two or more radially-extending slots. The second internal profile is also adapted to receive and engage a second nut which has an exterior profile which conforms to the second internal profile. The hand grip member also has an axially aligned opening which extends from the first end to the second end.

An embodiment of the wrench may have an arcuate opening in the outer wall of the handle member which provides manual access to either the first central aperture or the second central aperture. This feature allows a user to easily disengage nuts from the device by reaching a finger into the inside of the wrench to push the nut out, or to push the nut forward through the wrench and retrieve the nut through the arcuate opening. In the same manner, a user may easily disengage the plug inserts described below.

Embodiments of the wrench may be configured which may be used for all generally utilized nuts or nut fasteners used for toilet seats. This is achieved through the use of plug inserts which have exterior profiles which conform to either the first or second internal profiles. The plug inserts will have their own internal profiles which correspond to the exterior profile of the various desired nut shapes. However, because the external profiles of the plug inserts match the first or second internal profiles of the wrench body, the plug inserts are received and engaged by the sockets on either end of the handle member. The internal profiles of the plug inserts may be hexagonal, square, or may comprise radially extending lobes or slots. This feature allows a single handle member to be utilized for every type of toilet seat hardware commonly used.

DETAILED DESCRIPTION OF THE EMBODIMENTS

Figure 1:
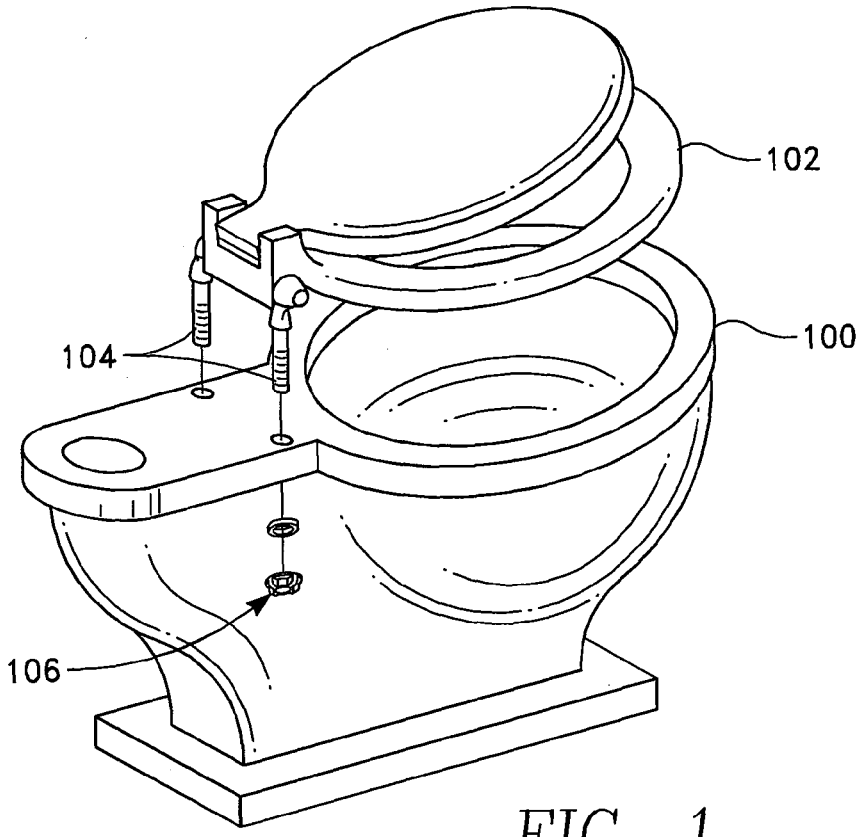
FIG. 1 shows a toilet bowl having a seat attached by nuts which may be removed and installed with embodiments of the present invention.
Figure 2:
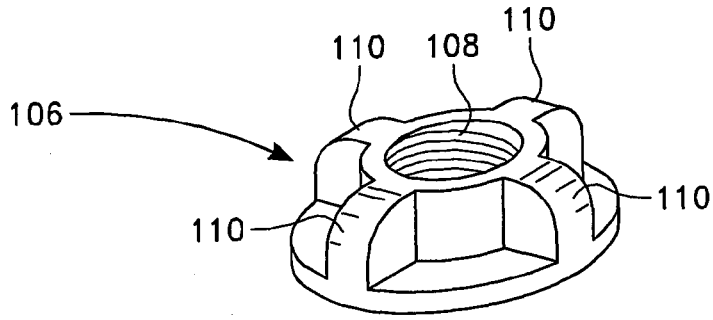
FIG. 2 shows a plastic nut commonly utilized for attaching toilet seats to toilet bowels, where the nut has an exterior profile having a plurality of outwardly extending lobes.

Referring now to the figures, FIG. 1 shows a toilet bowl 100 having a seat 102 which is attached to the bowl by bolts 104 and nuts 106. FIG. 2 shows one type of nut 106 utilized for mounting the seat 102 to the bowl 100. Nut 106 has an internal threaded diameter 108 for making up to bolts 104. Nut 106 has an exterior profile which may comprise a variety of shapes, such as outwardly extending lobe members 110. Nut 106 is typically plastic, such that the lobe members 110 may be easily broken or damaged. Typically, a person attempting to remove nut 106 from a bolt 104, or make the nut up on the bolt, will utilize a grasping tool such as pliers or channel locks to rotate the nut, or hold the nut as the bolt is rotated. However, as depicted in FIG. 1, the nuts 106 are typically located to the rear and on the bottom side of the bowl 100, making access difficult and uncomfortable.

Figures 3, 4, 5, 6, 7, 8:
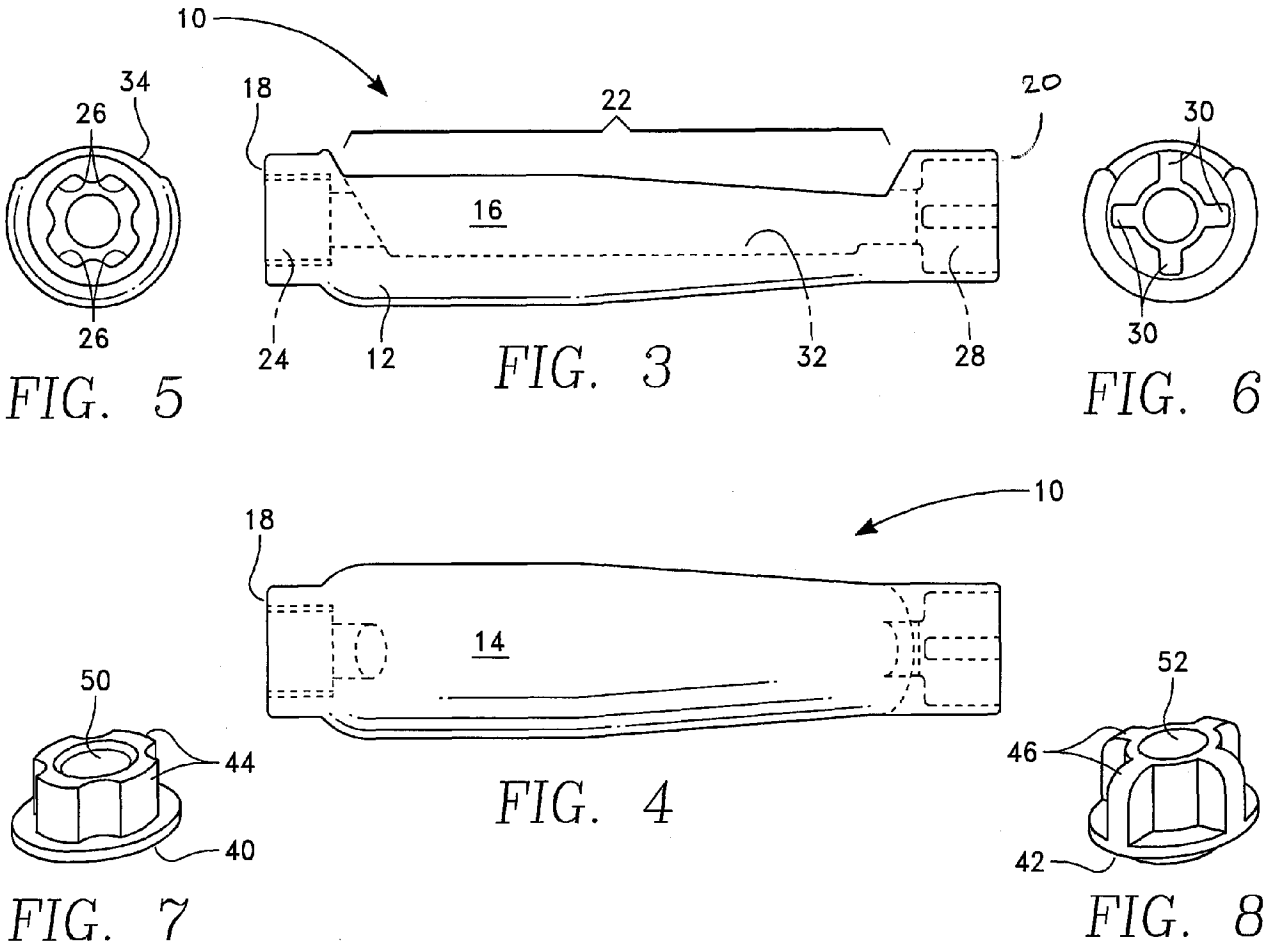
FIG. 3 shows a side view of an embodiment of the invention.
FIG. 4 shows a bottom view of an embodiment of the invention.
FIG. 5 shows a sectioned view of an embodiment of the invention looking toward the first end.
FIG. 6 shows a sectioned view of the invention looking toward the opposite end of the invention from that depicted in FIG. 5.
FIG. 7 shows an embodiment of a plug insert which may be utilized with embodiments of the invention.
FIG. 8 shows an embodiment of a plug insert which may be utilized with embodiments of the invention.

An embodiment of the wrench 10 has a hand grip member 12 which is a generally cylindrical body. The hand grip member 12 has an outer wall 14, an inner wall 16, a first end 18 and a second end 20. The hand grip member has an intermediate section 22 which extends between the first end 18 and the second end 20. The first end 18 has a first central aperture 24 which may extend into the intermediate section as shown in FIG. 3. The first central aperture 24 may have a first internal profile which has two or more radially-extending lobes 26. Alternatively, the first internal profile may be a hexagonal or square profile. The first internal profile is adapted to receive and engage a nut, such as nut 106, which has an exterior profile which conforms to the first internal profile. The second end 20 has a second central aperture 28 which may also extend into the intermediate section. Among other possible internal profiles, the second central aperture 28 may have a second internal profile which has two or more radially-extending slots 30. The second internal profile is also adapted to receive and engage a second nut (not shown) which has an exterior profile which conforms to the second internal profile. The hand grip member also has an axially aligned opening 32 which extends from the first end 18 to the second end 20. Among other purposes, the axially aligned opening 32 allows overly long bolts to pass through so that the internal profile (i.e, the nut engaging surface) can reach the nut.

Figure 9:
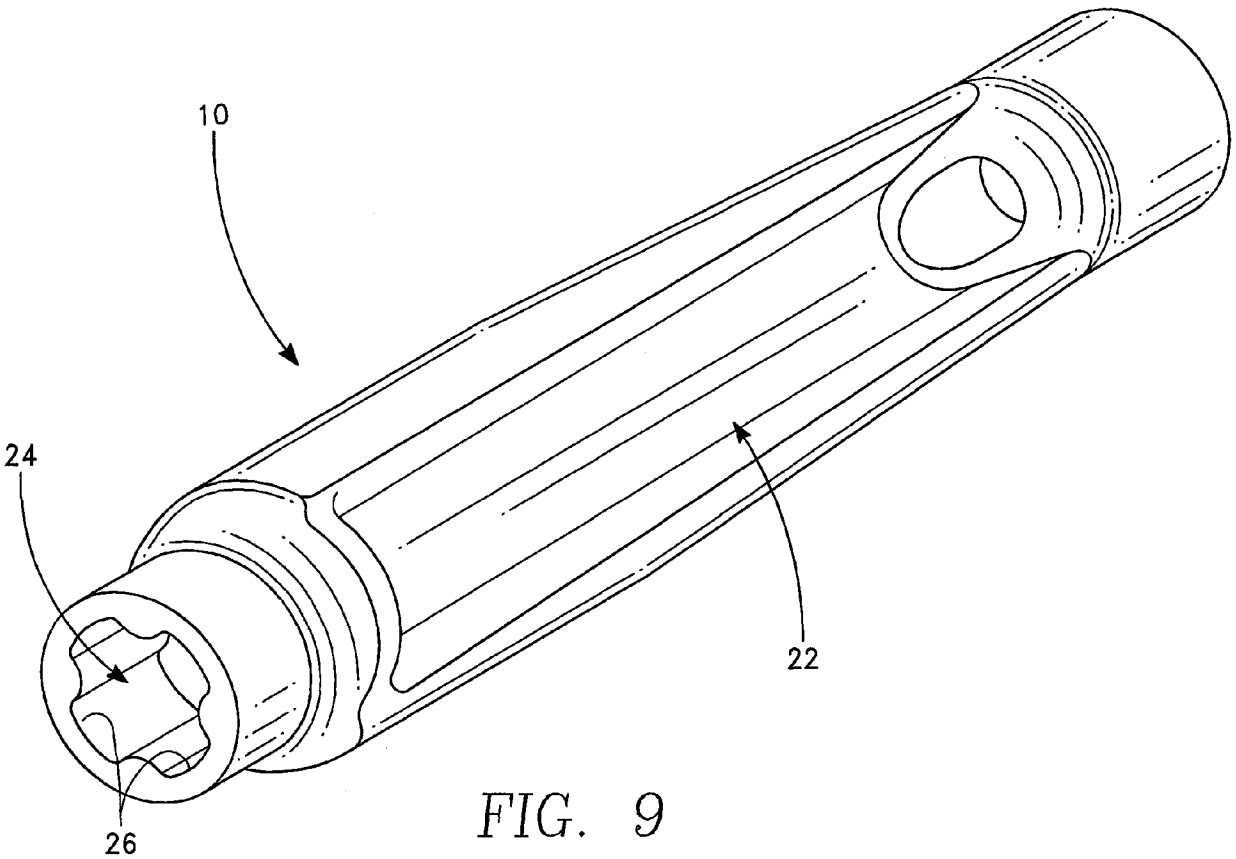
FIG. 9 shows a perspective view of an embodiment of the invention, showing an end which comprises radially extending lobes.
Figure 10:
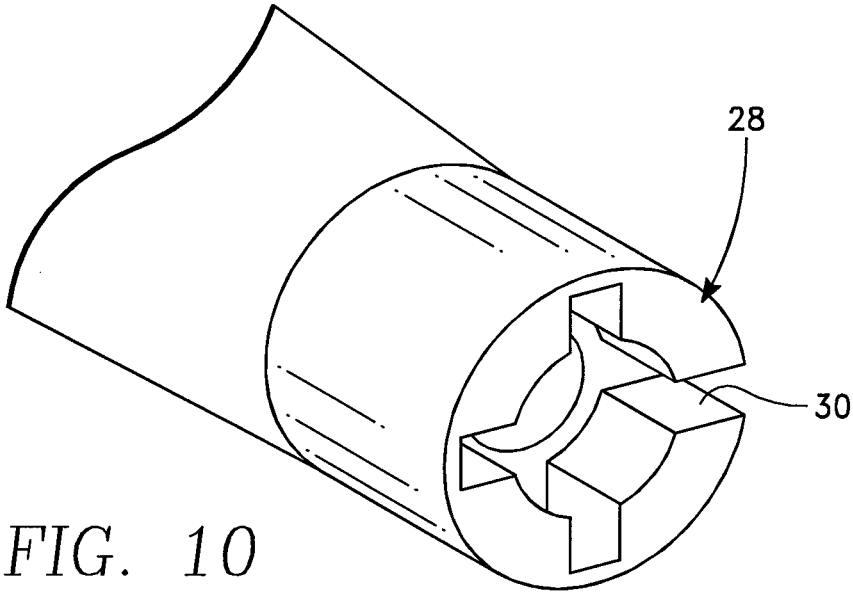
FIG. 10 shows an end view of an embodiment of the invention which comprises radially extending slots.
Figure 11:
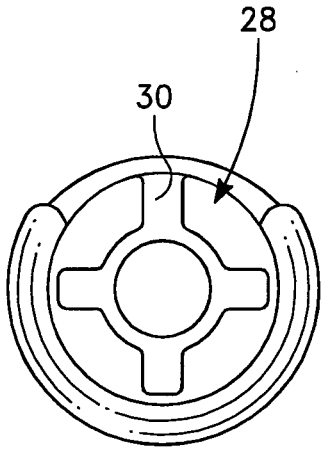
FIG. 11 shows an end view of the radially extending slots of FIG. 10.

An embodiment of the wrench may have an arcuate opening 34 in the outer wall 14 of the hand grip member 12 which provides manual access to either the first central aperture 24 or the second central aperture 28. This feature allows a user to easily disengage nuts from the device by reaching a finger into the inside of the wrench to push the nut out, or to push the nut forward through the wrench and retrieve the nut through the arcuate opening. In the same manner, a user may easily disengage the plug inserts described below. Arcuate opening 34 also facilitates the manufacture of the wrench if the device is produced through injection molding processes, which will typically be the method of manufacture. In one embodiment, the arcuate opening 34 may extend along a significant portion of the body of the device, as shown in FIG. 9. However, arcuate opening 34 may be different sizes, or the wall of the device may be continuous without any opening.

Embodiments of the wrench may be configured which may be used for all generally utilized nuts 106 or nut fasteners used for toilet seats 102. First central aperture 24 and second central aperture 28 will be configure to fit two different exterior nut profiles. Additional exterior nut profiles may be obtained through the use of plug inserts 40, 42 which have exterior profiles which conform to either the first or second internal profile of the hand grip member 12. For example, plug insert 40 may have radially extending lobes 44 which are adapted to be received and engaged by the internal profile of first central aperture 24, which has radially-extending lobes 26. Similarly, plug insert 42 have radially-extending ribs 46 which are adapted to be received and engaged by the internal profile of second central aperture 28, which as radially-extending slots 30.

Although FIGS. 7-9 suggest, for simplicity, a round internal profile, the plug inserts 40, 42 will have their own internal profiles 50, 52 which correspond to the exterior profile of the various desired nut shapes. Because the external profiles of the plug inserts 40, 42 match the first or second internal profiles of the hand grip member 12, the plug inserts are received and engaged by the sockets on either end of the hand grip. The internal profiles of the plug inserts 40, 42 may be hexagonal, square, or may comprise radially extending lobes or slots. This feature allows a single hand grip member 12 to be utilized for every type of toilet seat hardware commonly used.

A method of attaching and removing a toilet seat 102 to a toilet bowl 100 utilizes the apparatus described above, where the internal profiles of either the first central aperture 24, the second central aperture 28, or the internal profiles 50, 52 of plug inserts 40, 42 are matched with the nuts 106. Once the internal profiles have been matched, the wrench 10 is attached to the nut 106, a back-up tool employed as necessary, and the nuts 106 either loosened or tightened to bolts 104 as necessary for removal or attachment of toilet seat 102.

While the above is a description of various embodiments of the present invention, further modifications may be employed without departing from the spirit and scope of the present invention. For example, the size, shape, and/or material of the various components may be changed as desired. Thus the scope of the invention should not be limited by the specific structures disclosed. Instead the true scope of the invention should be determined by the following appended claims.

What is claimed is:

1. A wrench comprising:

a generally cylindrical hand grip member having an outer wall, an inner wall, a first end and a second end, an intermediate section between the first end and the second end;

a first central aperture extending from the first end into the intermediate section, the first central aperture having a first internal profile comprising a plurality of radially-extending lobes, the first internal profile adapted to engage a first nut having an exterior profile conforming to the first internal profile; and a second central aperture extending from the second end into the intermediate section, the second central aperture having a second internal profile comprising a plurality of radially-extending slots, the second internal profile adapted to engage a second nut having an exterior profile conforming to the second internal profile.

2. The wrench of claim 1 wherein the hand grip member comprises an axially aligned opening extending from the first end to the second end.

3. The wrench of claim 1 wherein the intermediate section comprises an arcuate opening in the outer wall providing manual access to the first central aperture.

4. The wrench of claim 1 wherein the intermediate section comprises an arcuate opening providing manual access to the second central aperture.

5. The wrench of claim 1 further comprising a first plug insert having an exterior profile conforming to the first internal profile of the first end, the first plug insert adapted to be received and engaged within the first internal profile, the first plug insert further comprising a central aperture having an internal profile adapted to engage a third nut.

6. The wrench of claim 5 wherein the internal profile of the first plug insert is hexagonal.

7. The wrench of claim 5 wherein the internal profile of the first plug insert is square.

8. The wrench of claim 5 wherein the internal profile of the first plug insert comprises a plurality of radially-extending lobes.

9. The wrench of claim 1 further comprising a second plug insert having an exterior profile conforming to the second internal profile of the second end, the second plug insert adapted to be received and engaged within the second internal profile, the second plug insert further comprising a central aperture having an internal profile adapted to engage a fourth nut.

10. A wrench for installing and removing a toilet seat comprising:

a generally cylindrical hand grip member having an outer wall, an inner wall, a first end and a second end, an intermediate section between the first end and the second end;

a first central aperture extending from the first end into the intermediate section, the first central aperture having a first internal profile comprising a plurality of radially-extending lobes, the first internal profile adapted to engage a first nut having an exterior profile conforming to the first internal profile;

a second central aperture extending from the second end into the intermediate section, the second central aperture having a second internal profile comprising a plurality of radially-extending slots, the second internal profile adapted to engage a second nut having an exterior profile conforming to the second internal profile;

a first plug insert having an exterior profile conforming to the first internal profile of the first end, the first plug insert adapted to be received and engaged within the first internal profile, the first plug insert further comprising a central aperture having an internal profile adapted to engage a third nut; and a second plug insert having an exterior profile conforming to the second internal profile of the second end, the second plug insert adapted to be received and engaged within the second internal profile, the second plug insert further comprising a central aperture having an internal profile adapted to engage a fourth nut.

11. The wrench of claim 10 wherein the hand grip member comprises an axially aligned opening extending from the first end to the second end.

12. The wrench of claim 10 wherein the intermediate section comprises an arcuate opening in the outer wall providing manual access to the first central aperture.

13. The wrench of claim 10 wherein the intermediate section comprises an arcuate opening providing manual access to the second central aperture.

14. The wrench of claim 10 wherein the internal profile of the first plug insert is hexagonal.

15. The wrench of claim 10 wherein the internal profile of the first plug insert is square.

16. The wrench of claim 10 wherein the internal profile of the first plug insert comprises a plurality of radially-extending lobes.

17. The wrench of claim 10 used in the installation or removal of a toilet seat, where the method comprises the steps of:

matching an exterior profile of a nut for retaining the toilet seat with the internal profiles of either the first internal profile, the second internal profile, the internal profile of the first plug insert, or the internal profile of the second plug insert; and loosening or tightening each nut as necessary for installing or removing the toilet seat.

* * * * *